United States Patent [19]

Curtiss et al.

[11] Patent Number: 5,042,510

[45] Date of Patent: Aug. 27, 1991

[54] SIMULATED CIGARETTE

[76] Inventors: Philip F. Curtiss, 3426 Glouchester La.; Laurelyn H. Southworth, 7 Red Fern Ct., both of Greensboro, N.C. 27408

[21] Appl. No.: 462,129

[22] Filed: Jan. 8, 1990

[51] Int. Cl.[5] ..... A24D 1/00; A24D 1/18; A24F 47/00

[52] U.S. Cl. ..... 131/273; 131/270; 131/272

[58] Field of Search ..... 131/273, 270, 272

[56] References Cited

U.S. PATENT DOCUMENTS 3,410,273 11/1968 Bolles .
3,674,037 7/1972 Fortune .
3,683,936 8/1972 O'Neil, Jr. .
3,789,840 2/1974 Rosenblatt .
4,284,089 8/1981 Ray .
4,945,929 8/1990 Egilmex ..... 131/273

*Primary Examiner*—V. Millin
*Attorney, Agent, or Firm*—Rhodes, Coats & Bennett

[57] ABSTRACT

A cigarette-like device that contains no tobacco and is not intended to be lit, includes a simulated filter/regulator and a barrel portion. One or more transverse air passages allow air to enter the sides of the filter/regulator and travel along an interior longitudinal core or passageway to the user's lips where the sensation of puffing is realized. The end of the core adjacent the barrel portion is sealed to prevent passage of air from the barrel through the core in the filter portion in case a match is inadvertently applied to the barrel. This prevents inhalation of the flame or hot gases. The barrel is formed of a semi-rigid, self-extinguishing, non-toxic, polymeric material such as PVC without heavy metal stabilizers.

19 Claims, 2 Drawing Sheets

FIG. 1
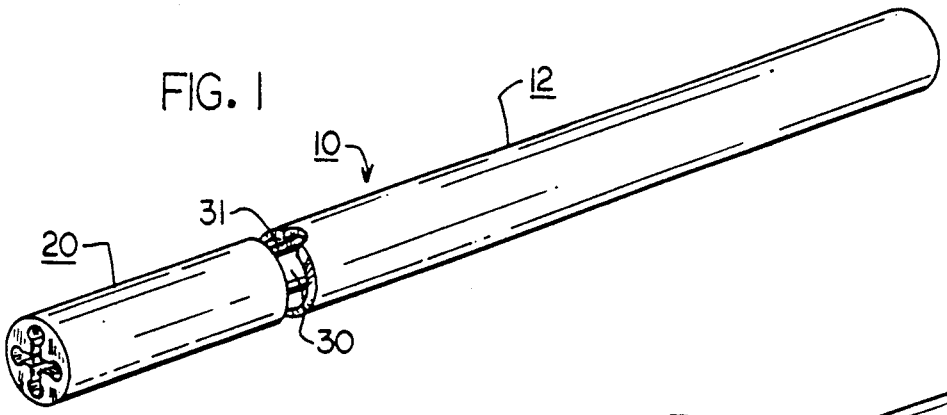
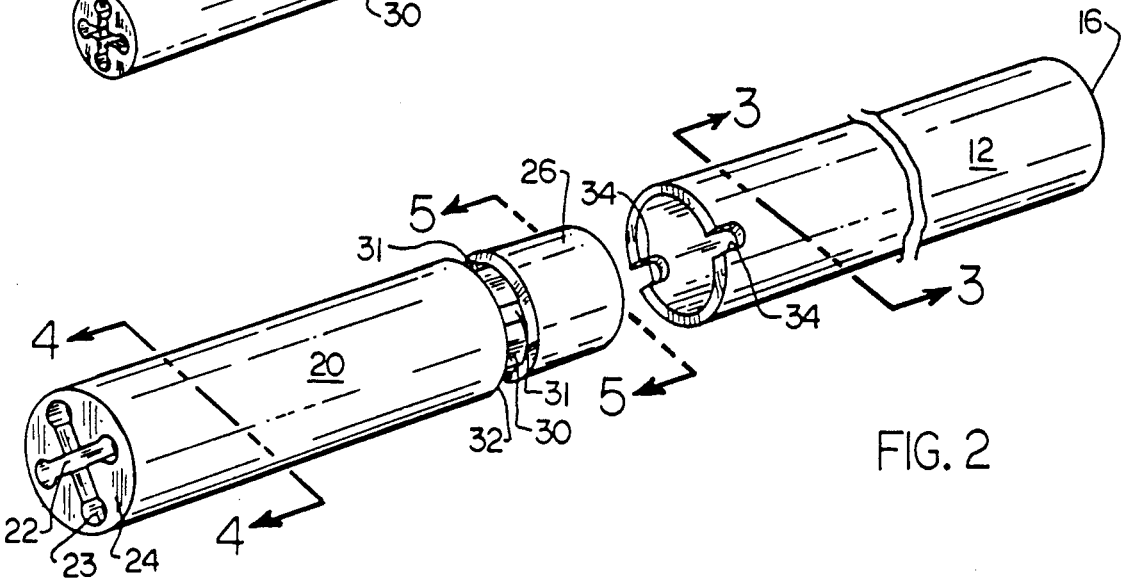
FIG. 2
FIG. 3
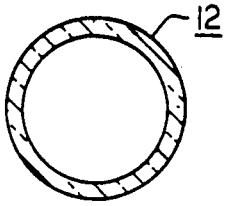
FIG. 4
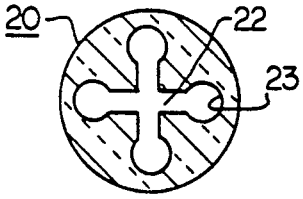
FIG. 5
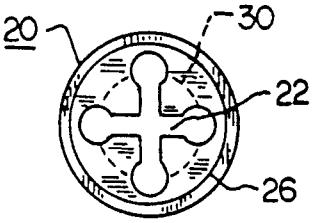

SIMULATED CIGARETTE

BACKGROUND AND SUMMARY OF THE PRESENT INVENTION

The present invention is directed to smokers' articles and, more particularly, to a simulated cigarette device which does not contain tobacco, which is not lit, but which is intended to assist cigarette smokers to quit the habit.

For some thirty years, the public has been made increasingly aware of the dangers and risks of smoking cigarettes and other tobacco products. Once the cigarette habit is obtained, it is very difficult to discontinue. A large percentage of cigarette smokers have been unable to eliminate the habit. As a result, various types of devices and techniques have developed for assisting cigarette smokers to discontinue the potentially harmful practice.

Such approaches include seminars in behavior modification, psychological counseling, hypnotism, lozenges, gum, and other nicotine substitutes. However, there are apparently certain psychological factors which are acquired after years of smoking cigarettes, which cannot be easily satisfied by a lozenge, gum, or other nicotine substitutes. A habitual cigarette smoker enjoys holding the cigarette, putting it in his mouth, and sucking or drawing on it. Medical experts agree that deep breathing provides relief from tension. All of these factors contribute to the enjoyment of the cigarette experience.

There have been some attempts to provide cigarette-like devices for assisting cigarette smokers to discontinue smoking. For example, in the Rosenblatt U.S. Pat. No. 3,789,840, there is disclosed a cigarette-like device which includes a plastic barrel with a removable tip. The tip is actually a molded lozenge and, when it is dissolved by the user, a new lozenge tip is emplaced on the plastic barrel.

The O'Neil, Jr. U.S. Pat. No. 3,683,936 is an example of an actual cigarette which has tobacco and is lit. An air impermeable block is placed between the combustible material and the filter to prevent the inhalation of any smoke. While this device allows the user to fondle, feel and place the cigarette-like device in his mouth, there is no sensation of sucking, drawing, or puffing on the cigarette. There also appears to be a problem in causing the device to burn.

The Ray U.S. Pat. No. 4,284,089 is exemplary of a device having the approximate dimensions of a cigarette, through which air is drawn, and in which a source of vaporizable nicotine is placed. There is, however, no way to prevent inhalation of smoke, flame, or hot gases should this device be accidentally lit.

In the present invention, however, an attempt is made to provide a cigarette-like device which satisfies the aforesaid psychological factors of holding, fondling, placing the cigarette device between the lips of the user, and sucking, puffing or drawing. The sensation of drawing air into the mouth is accomplished by transverse openings in the simulated filter/regulator or tip which communicate with a longitudinal passageway. There is thus provided for the passage of air through the sides of the regulator and through the longitudinal passageway into the mouth. However, the regulator and barrel are separate components. A sealing means is provided between the longitudinal passageway and barrel to prevent the passage of air from the barrel through the filter into the mouth. Therefore, should the cigarette-like device be lit accidentally, flames, smoke, or hot gases cannot pass through the air regulator into the mouth of the user. The barrel is formed of a non-toxic, self-extinguishing polymeric material so that, even if a match is applied, it is soon extinguished and is therefore not dangerous.

From the standpoint of manufacture, the most economical approach is to extrude a tubular filter/regulator or a cylindrical member having a profile shape extending therethrough. The profile shape can be formed by extruding, then cutting, lengths from continuous stock. One end of the regulator is reduced in diameter to form a cylindrical projection that fits into the barrel. A peripheral groove is cut further into the projection or into another portion of the barrel to intersect the profile and provide a vent means into the core. The end of each filter/regulator adjacent the barrel is then sealed. Alternatively, the filter/regulator can be injection-molded where manufacturing economies warrant the construction of the more expensive die.

In the preferred embodiment, the peripheral groove which provides communication with the hollow profile is formed at the interface between the barrel member and the filter/regulator. The tip is slid longitudinally or rotated within the barrel to adjust the opening to the central core or flue. Thus, the user may adjust the amount of draft he/she receives with each draw.

It is, therefore, an object of the present invention to provide a simulated cigarette that contains no tobacco and is not intended to be lit. Rather, it allows for drawing in a deep breath of air with the potential to provide relief from tension.

Another object of the present invention is to provide a simulated cigarette of the type described which prevents passage of air from the barrel through the tip portion (filter/regulator) to prevent inhalation of flame.

Yet another object of the present invention is to provide a simulated cigarette in which the barrel is formed of non-toxic material.

A still further object of the present invention is to provide a simulated cigarette which includes air passages in the filter/regulator that allow air to enter transversely and then travel along an interior longitudinal passageway to provide the feel of puffing or drawing the cigarette.

Other objects and a fuller understanding of the invention will become apparent from reading the following detailed description of the preferred embodiment along with the accompanying drawings in which:

FIG. 1 is a perspective view of a preferred embodiment of the simulated cigarette according to the present invention;

FIG. 2 is an enlarged, exploded perspective view, with parts broken away, of the simulated cigarette according to FIG. 1;

FIG. 3 is a sectional view taken through the barrel substantially along lines 3—3 in FIG. 2;

FIG. 4 is a sectional view taken along lines 4—4 substantially through the air regulator;

FIG. 5 is an end view of the air regulator looking at the end which is inserted into the barrel;

DETAILED DESCRIPTION OF A PREFERRED EMBODIMENT

Figure 6:
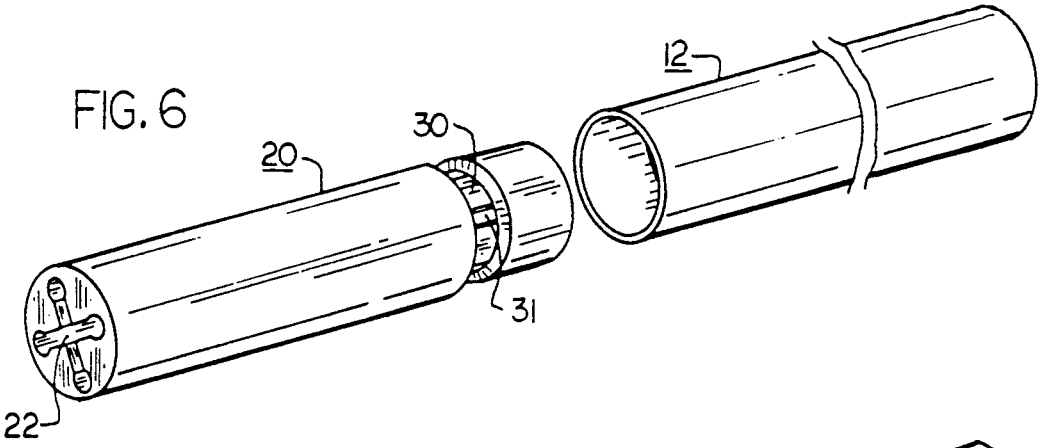
FIG. 6 is a perspective view, with parts broken away, illustrating a first alternate embodiment of the present invention.

Turning now to FIGS. 1–5, there is illustrated a preferred embodiment of the present invention. Looking first at FIG. 1, the present invention is directed to a simulated cigarette 10 which includes a barrel portion or member 12 and a tip member 20 (simulated filter/air regulator). As illustrated in FIG. 2, the barrel portion 12 is formed of a hollow, tubular, semi-rigid, non-toxic, self-extinguishing polymeric material. The outer diameter is substantially the same as a conventional cigarette (approximately 7.0–8.5 mm). The length of the barrel also closely approximates the length of the non-filter portion of a conventional cigarette (approximately 66–75 mm). The length and diameter may vary slightly. However, it should conform closely to the size and shape of conventional cigarettes.

The material from which barrel 12 is formed may also vary to meet the requirements of being semi-rigid, non-toxic, and self-extinguishing. However, for purposes of this description, one material that is satisfactory and meets all of the required parameters is non-toxic polyvinyl chloride (PVC). A non-toxic PVC is one in which the stabilizers used therein are free from heavy metals such as tin and lead. Other possible polymers include both polypropylene and low density polyethylene, each of which should be compounded with an appropriate flame-retardant additive. The barrel 12 is semi-rigid, so that it closely resembles the feel of a conventional cigarette. The term "semi-rigid", as used herein, means having a durometer of approximately 100 (95–105) A scale. It is self-extinguishing in case it inadvertently is subjected to the flame of a match or cigarette lighter. The inner diameter of the barrel 12 is selected to receive a reduced diameter projection extending from the regulator 20 for assembling the two pieces as will be described hereinafter. Preferably the barrel inner diameter is approximately 0.005 inch smaller than the outer diameter of the aforesaid projection to provide a friction fit.

The regulator portion 20 is preferably formed of a high impact, non-toxic polymeric material such as high impact polystyrene or medium to low density polyethylene. The surface of regulator 20 should have a slightly roughened surface texture to closely resemble the feel and rigidity of a conventional cigarette filter portion. The high impact characteristic allows the regulator to be drilled, punched or molded and provides sufficient strength so that the projection 26 of reduced diameter will not snap off. The term "high impact", as used herein, means in the range of 3–5 izod. The filter portion 20 has a diameter that is substantially identical to the diameter of the barrel portion 12 and is of a length which closely resembles the length of the filter portion of a conventional cigarette (approximately 26 mm).

A hollow core 22 may be either circular or may have a profile such as that illustrated in FIG. 2. In FIG. 2, the profile of hollow core 22 is cross-shaped with enlarged or bulbous end portions 23. The profile is extruded along with the regulator portion 20. Molten polymeric material is forced past a die having a core substantially the same shape as the core profile.

The tip portion has a first end that, in use, is placed between the lips of the consumer. The second end includes an axially extending projection 26 which is of a smaller diameter than the main body of the tip portion 20. Projection 26 is of such a diameter as to be insertable into the adjacent end 14 of barrel 12. Once inserted, attachment may be affected by a friction fit between the interiors of the barrel and projection 26, or by use of a conventional non-toxic adhesive between the surface of projection 26 and the inner wall of barrel 12. A suitable sealant is silicone glue or a hot melt glue. When assembled, a sealant 28 is provided in the hollow core 22 adjacent the second end 26 to prevent passage of air from the hollow barrel 12 into the tip member. The sealant may be the same silicone glue or hot melt glue. This prevents the consumer from inhaling flames in case a match or cigarette lighter is placed to the barrel end of the simulated cigarette.

In order to provide for the free passage of air through the tip portion 20, a side draft is effective by using one or more grooves 30 which is cut through the wall of projection 26 adjacent the wall 32 of regulator 20 that abuts the adjacent wall 14 of barrel 12. Groove 30 is cut deeply enough to provide a plurality of vent means 31 which communicates with the ends of the hollow profile 22. In FIGS. 4 and 5, it can be seen that the radius defined by the ends of the cross-shaped hollow core is less than the diameter of projection 26. Air then passes through the grooves and into the hollow core 22, from whence it passes along the length thereof into the mouth of the user. The effect of puffing or drawing on the cigarette may then be realized. In the preferred embodiment, groove 30 is between the second end 14 of the barrel portion and the wall 32 which forms the longitudinal extent of the filter/regulator 20. One or more slots 34 are provided in adjacent end 14 of barrel. Barrel 12 may then be rotated to align or misalign slots 34 with the vent passages 31. If the tip portion 20 is assembled to the barrel portion 12 by friction only and without adhesive, then the amount of air which the user is able to inhale may be controlled by rotating the regulator 20 with respect to the barrel portion.

Alternatively (FIG. 6), the regulator 20 may be adjusted longitudinally within the barrel 12'. In this approach, the groove 30 may be widened or narrowed to expand or constrict the vent passages for air. Additional grooves may be cut as desired. In this embodiment, slots 34 would not exist.

Figure 7:
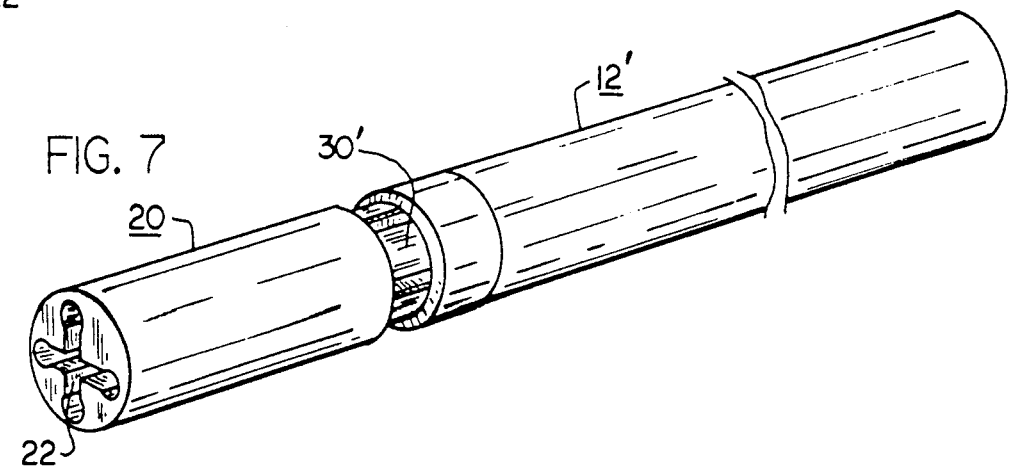
FIG. 7 is a perspective view, with parts broken away, illustrating a second alternate embodiment of the invention.
Figure 8:
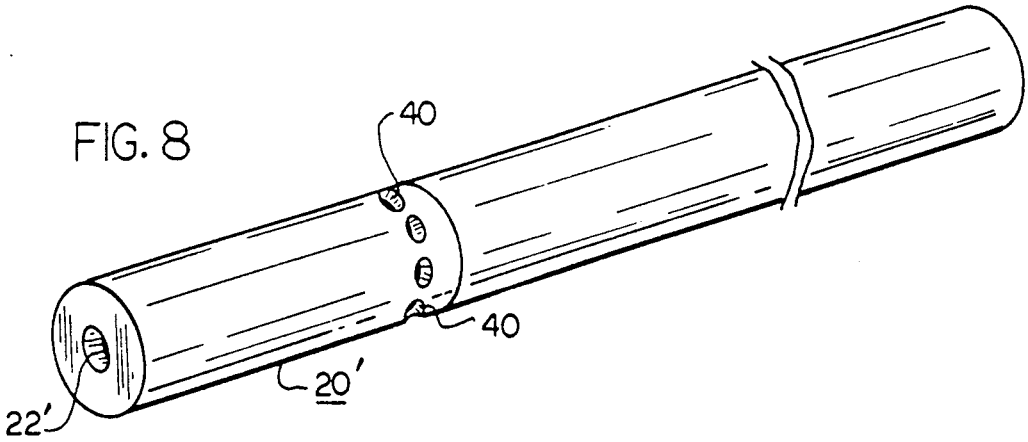
FIG. 8 is a perspective view, with parts broken away, illustrating a third alternate embodiment of the present invention.
Figure 9:
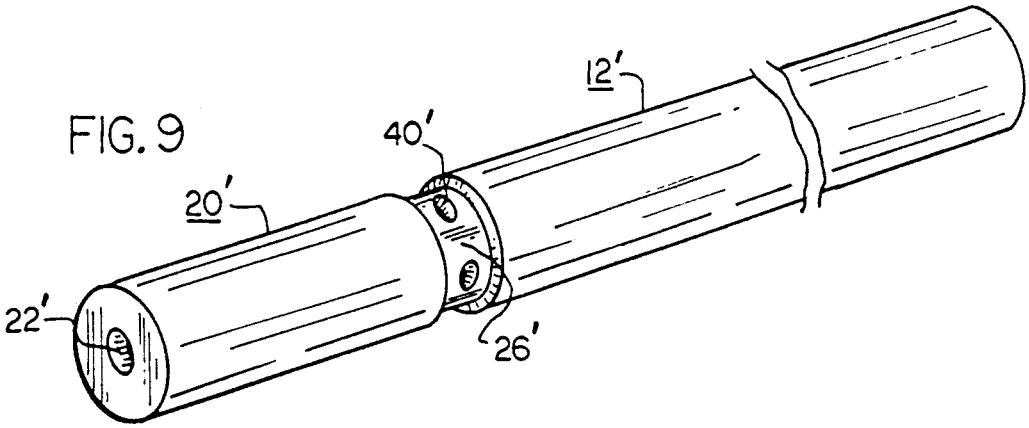
FIG. 9 is a perspective view of a fourth alternate embodiment of the present invention.

In FIG. 7, there is illustrated a second alternate embodiment in which the groove 30' is not formed between the end wall 32 of regulator 20 and the second end 14 of barrel member 12. Rather, the groove 30' is formed further up the regulator 20 and no adjustment for varying the inflow of air is thereby made. In the third alternate embodiment illustrated in FIG. 8, the hollow core 22' is circular. So arranged, rather than grooves 30,30', a plurality of holes 40 must be drilled or punched around the periphery of the filter portion at spaced locations to allow the side draft. The passage of air may also be changed by adding more grooves 30,30', deepening grooves 30,30', or by drilling or punching more holes 40. In FIG. 9, the holes 40' are formed in the projection 26' and provide communication through the wall thereof to the circular hollow core 22'. Again the passage of air is controlled by sliding the regulator 20' within barrel 12'.

The projection 26 is of a diameter of such size and shape to fit into the barrel 12 with or without adhesive. The semi-rigid barrel material allows the inner barrel diameter to be slightly smaller than the projection diameter to provide the friction fit. As stated hereinabove, the core 22 of the filter portion must be sealed at the second end to prevent the drawing of air through the barrel and into the filter portion.

As an added feature, flavors in the form of oils, or other forms compatible with the construction, may be inserted into the hollow core 22 as an option.

While a preferred embodiment has been described in detail hereinabove, it is apparent that various changes and modifications might be made without departing from the scope of the invention which is set forth in the accompanying claims.

What is claimed is:

1. A simulated cigarette device comprising:

a) a cylindrical hollow barrel member being of substantially the same size and shape as a conventional cigarette and being formed of a semi-rigid polymeric material;

b) a cylindrical tip/regulator member being of substantially the same diameter as said barrel member;

c) said barrel member having a first free end and a second end adjacent said tip/regulator member, and said tip/regulator member having a first end which, in use, is placed between the lips of the user and a second end;

d) means for attaching said tip/regulator member to said barrel member;

e) said tip/regulator member including an open core configuration extending longitudinally therethrough;

f) at least one transverse vent means extending through the wall of said tip/regulator member into said core whereby air is drawn in through said vent means and longitudinally of said core responsive to negative pressure applied at the mouthpiece end;

g) sealing means attached to the end of said tip/regulator member adjacent the interior of said barrel for isolating the core of said tip/regulator member and the interior of said barrel member, whereby air cannot be drawn through said barrel member and into the mouth of the user.

2. The cigarette device according to claim 1 wherein said polymeric material which forms said barrel member is non-toxic and self-extinguishing.

3. The cigarette device according to claim 2 wherein said barrel member is formed of a polymeric material selected from the group consisting essentially of high impact styrene and medium to low density polyethylene, said polymeric material having an izod impact range between 3 and 5 izod.

4. The cigarette device according to claim 2 wherein said tip is formed of a non-toxic polymeric material which is more rigid than said barrel member.

5. The cigarette device according to claim 1 wherein said means for attaching said tip/regulator member to said barrel member includes an axially extending projection having a diameter less than the diameter of said tip member and being of such dimensions as to be received within the adjacent end of said hollow barrel.

6. The cigarette device according to claim 5 wherein said attaching means further includes a non-toxic adhesive material between the surface of said projection and the inner wall of said barrel.

7. The cigarette device according to claim 5 wherein said attaching means comprises a friction fit between the exterior wall of said projection and the inner wall of said barrel.

8. The cigarette device according to claim 1 wherein said core is formed by a passageway which is circular in cross-section, and wherein transverse vent means includes a plurality of holes which extend from outside the periphery of the tip/regulator member, radially through the wall thereof, and into the circular passageway.

9. The cigarette device according to claim 8 wherein said means for attaching said tip/regulator member to said barrel member includes an axially extending projection having a diameter less than the diameter of said tip member and being of such dimension as to be frictionally received within the adjacent end of said hollow barrel.

10. The cigarette device according to claim 9 wherein said plurality of holes which form said transverse vent means extend through the wall of said projection, whereby the amount of air entering the core is controlled by sliding the barrel member longitudinally relative to said tip/regulator member.

11. The cigarette device according to claim 1 wherein said core is formed by a passageway having a cross-sectional profile that includes a central open area and a plurality of radially extending fingers extending outwardly therefrom, but having a span less than the diameter of said tip portion, and said transverse vent means includes at least one peripheral groove in the wall of said tip member that is sufficiently deep to intersect said fingers.

12. The cigarette device according to claim 11 wherein one of said peripheral grooves is formed between the confronting end walls of said barrel member and said tip/regulator member.

13. The cigarette device according to claim 12 wherein said confronting end wall of said barrel member includes at least one slot therein and wherein said attaching means comprises a friction fit between the exterior wall of said projection and the inner wall of said barrel, whereby the amount of air entering said core is controlled by rotating said barrel member relative to said tip/regulator member.

14. The cigarette device according to claim 12 wherein said attaching means comprises a friction fit between the exterior wall of said projection and the inner wall of said barrel and wherein the amount of air is controlled by sliding the barrel longitudinally relative to said tip/regulator member.

15. The cigarette device according to claim 11 wherein said tip member is extruded with said cross-sectional profile therein.

16. The cigarette device according to claim 1 wherein said sealing means includes an air impervious wall across the second end of said tip member.

17. The cigarette device according to claim 1 and further including a flavoring substance placed within said core.

18. The cigarette device according to claim 17 wherein said barrel member is formed of a polymeric materials selected from the group consisting essentially of polyvinyl chloride, polypropylene, and low density polyethylene, said polymeric material having a durometer in the range of 95–105 (A scale).

19. A simulated cigarette device comprising;

a. a cylindrical barrel member being of substantially the same size and shape as a conventional cigarette;

b. a cylindrical tip/regulator member being of substantially the same diameter as said barrel member;

c. said barrel member having a first free end and a second end adjacent said tip/regulator member, and said tip/regulator member having a first end which, in use, is placed between the lips of the user and a second end;

d. means for telescopically attaching said tip/regulator member to said barrel member so that said tip/regulator is slidably and rotatably mounted in said barrel member.

e. said tip/regulator member including an open core configuration extending longitudinally therethrough;

f. at least one transverse vent means extending through the wall of said tip/regulator member into said core whereby air is drawn in through said vent means and longitudinally of said core responsive to negative pressure applied at the mouthpiece end;

g. means for adjusting the volume of air delivered through said transverse vent means by the manipulation of said tip regulator member; and h. sealing means for isolating the core of said tip/-regulator member and the interior of said barrel member, whereby air cannot be drawn through said barrel member and into the mouth of the user.

* * * * *